US006199383B1

(12) United States Patent
Pusateri

(10) Patent No.: US 6,199,383 B1
(45) Date of Patent: Mar. 13, 2001

(54) PNEUMATIC TOOL AND AIR DEFLECTOR BOOT THEREFOR

(75) Inventor: Daniel S. Pusateri, Grayslake, IL (US)

(73) Assignee: Snap-on Tools Company, Kenosha, WI (US)

( * ) Notice: Subject to any disclaimer, the term of this patent is extended or adjusted under 35 U.S.C. 154(b) by 0 days.

(21) Appl. No.: 09/248,888

(22) Filed: Feb. 11, 1999

(51) Int. Cl.[7] ..... F01B 31/00
(52) U.S. Cl. ..... 60/695; 173/171
(58) Field of Search ..... 60/407, 695; 173/168, 173/169, 170, 171; 91/404

(56) References Cited

U.S. PATENT DOCUMENTS

| | | | | |
|---|---|---|---|---|
| 1,115,704 | * | 11/1914 | Manes | 60/695 X |
| 1,594,232 | | 7/1926 | Zimmermann . | |
| 1,641,357 | | 9/1927 | Slater . | |
| 1,712,437 | * | 5/1929 | imerson | 60/695 |
| 1,787,960 | | 1/1931 | Slater . | |
| 1,832,152 | | 11/1931 | Stewart | 60/695 |
| 2,027,579 | | 1/1936 | DeMooy . | |
| 3,554,316 | | 1/1971 | Judd et al. . | |
| 3,675,734 | | 7/1972 | Blatt et al. . | |
| 3,695,362 | | 10/1972 | Klessing . | |
| 3,712,415 | | 1/1973 | Blatt et al. . | |
| 3,823,795 | | 7/1974 | Fleigle . | |
| 3,873,862 | | 3/1975 | Butler . | |
| 4,042,062 | | 8/1977 | Tooley . | |
| 4,196,834 | | 4/1980 | Beton . | |
| 4,258,798 | | 3/1981 | Campbell et al. . | |
| 4,370,855 | | 2/1983 | Tuggle . | |
| 4,434,858 | | 3/1984 | Whitehouse . | |
| 4,617,909 | | 10/1986 | Molitor . | |
| 4,654,198 | | 3/1987 | Berardini . | |
| 4,751,980 | | 6/1988 | DeVane . | |
| 4,815,934 | | 3/1989 | Rademaker . | |
| 4,834,131 | | 5/1989 | Austin . | |
| 5,006,740 | | 4/1991 | Palm | 310/50 |
| 5,020,607 | | 6/1991 | Sentivan | 173/171 |
| 5,309,714 | | 5/1994 | Putney et al. . | |
| 5,418,339 | | 5/1995 | Bowen et al. . | |
| 5,468,186 | | 11/1995 | Bolton et al. . | |
| 5,609,028 | | 3/1997 | Kakuda et al. . | |
| 5,729,977 | | 3/1998 | Zibble et al. . | |
| 5,924,497 | | 7/1999 | Spooner et al. . | |
| 5,992,540 | * | 11/1999 | Smolinski et al. | 173/169 |

* cited by examiner

*Primary Examiner*—John E. Ryznic
(74) *Attorney, Agent, or Firm*—Seyfarth Shaw

(57) ABSTRACT

A combination pneumatic tool and protection boot are provided. The pneumatic tool has a housing and an exhaust port for transmitting exhaust air from the tool along a path. The protective boot is disposed about the housing and has a deflector disposed in the path of the exhaust air for redirecting the exhaust air. The deflector preferably deflects the air away from an area surrounding the workpiece the tool is engaging without creating back pressure in the tool.

19 Claims, 3 Drawing Sheets

PNEUMATIC TOOL AND AIR DEFLECTOR BOOT THEREFOR

BACKGROUND OF THE INVENTION

1. Field of the Invention

This invention relates to pneumatic tools, and more particularly, to protective boots therefor.

2. Description of the Prior Art

Protective boots for disposal about the housing of a pneumatic tool have previously been provided to afford protection to the tool. Users, however, often do not see any reason to use these boots and often either do not use the boots, or do not replace damaged boots. Consequently, the pneumatic tools often become damaged.

Additionally, deflectors have been affixed to the housing of a pneumatic tool in front of a forward-facing exhaust port to deflect exhaust air away from the workpiece the tool is engaging. The deflectors aid in preventing exhaust air from causing dust or other debris from being blown about and inhaled, or ingested, by a user. These deflectors, however, can create back pressure in the tool which lowers the output torque of the tool.

SUMMARY OF THE INVENTION

It is a general object of the invention to provide an improved pneumatic tool which avoids the disadvantages of prior pneumatic tools while affording additional structural and operational advantages.

An important feature of the invention is the provision of a pneumatic tool which is of relatively simple and economical construction.

A further feature of the invention is the provision of a tool of the type set forth which diverts exhaust air emerging from the tool exhaust port without creating back pressure.

Another feature of the invention is the provision of a tool of the type set forth which diverts exhaust air from the vicinity of the work piece.

With regard to the above two features, another feature of the invention is the provision of a protective boot with a deflector for diverting the exhaust air, which encourages a user to maintain the protective boot on the housing of the tool.

Certain ones of these or other features may be attained by providing a combination including a pneumatic air tool having a housing and an exhaust port for transmitting exhaust air from the tool along a path, and a protective boot disposed about the housing and having a deflector disposed in the path of the exhaust air for redirecting the exhaust air.

Brief Description of the Drawings

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
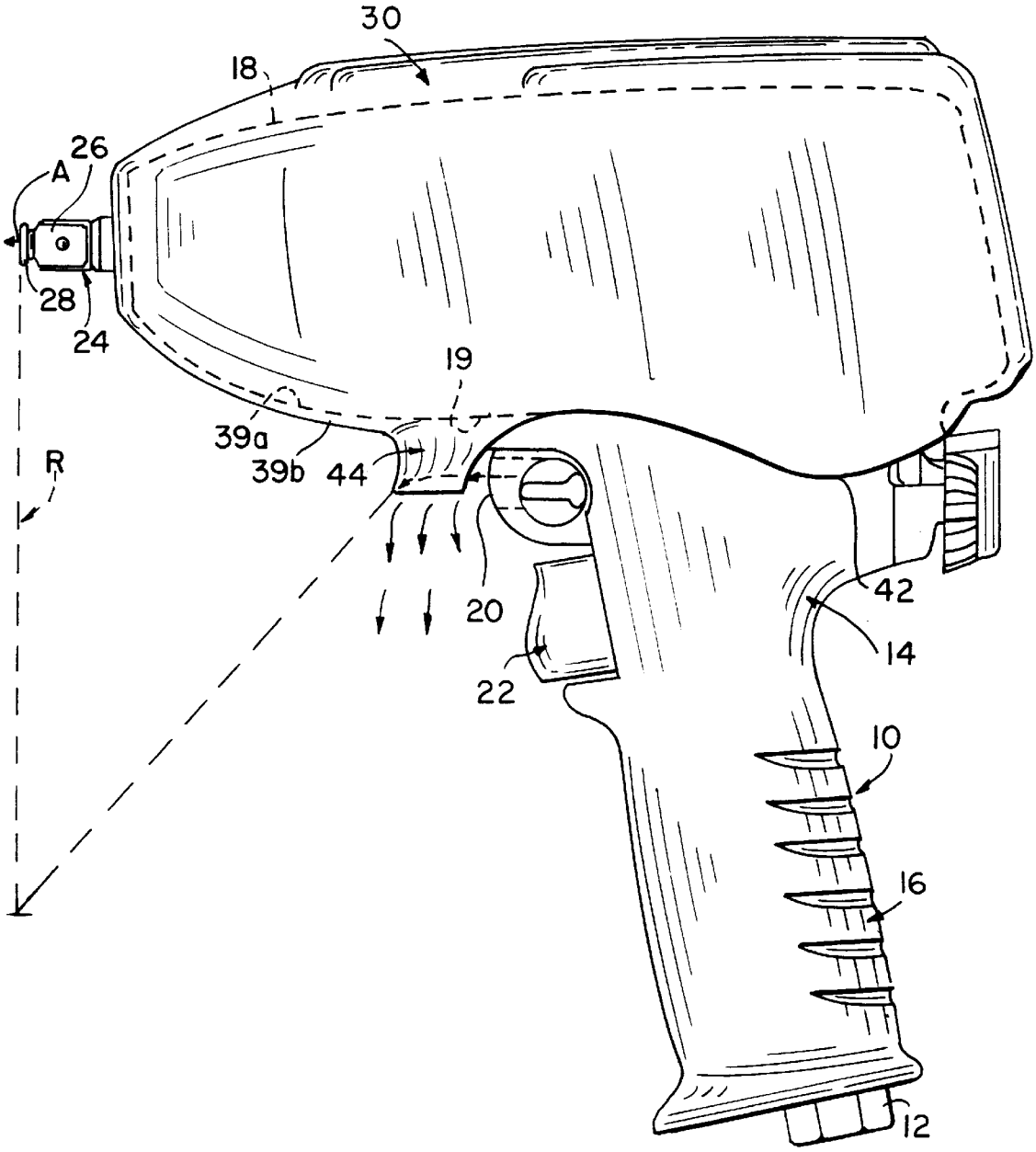
FIG. 1 is a side elevational view of the pneumatic tool and protective boot of the present invention.
Figure 2:
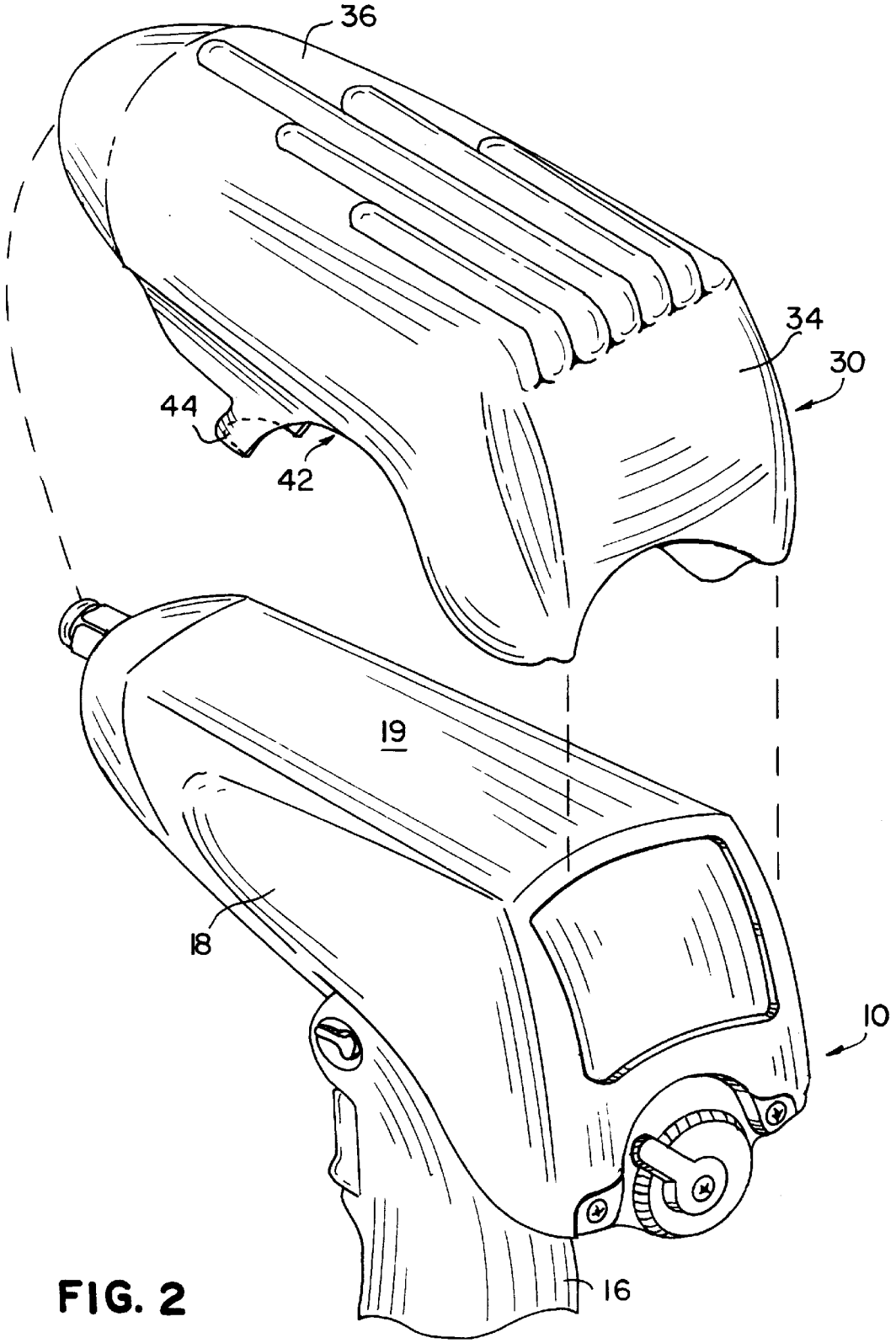
FIG. 2 is an exploded, fragmentary, rear perspective view of the tool and boot of FIG. 1.
Figure 5:
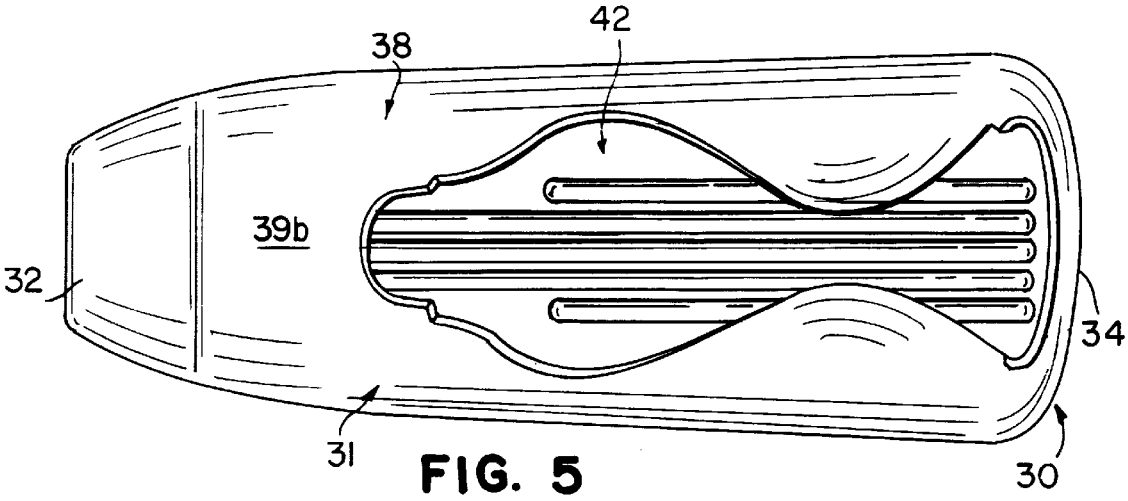
FIG. 5 is a bottom plan view of the boot of FIG. 2.
Figure 4:
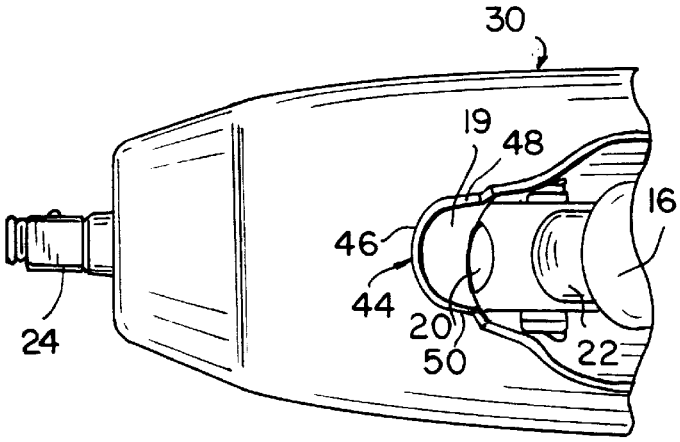
FIG. 4 is a partial bottom plan view of the tool and boot of FIG. 1.
Figure 3:
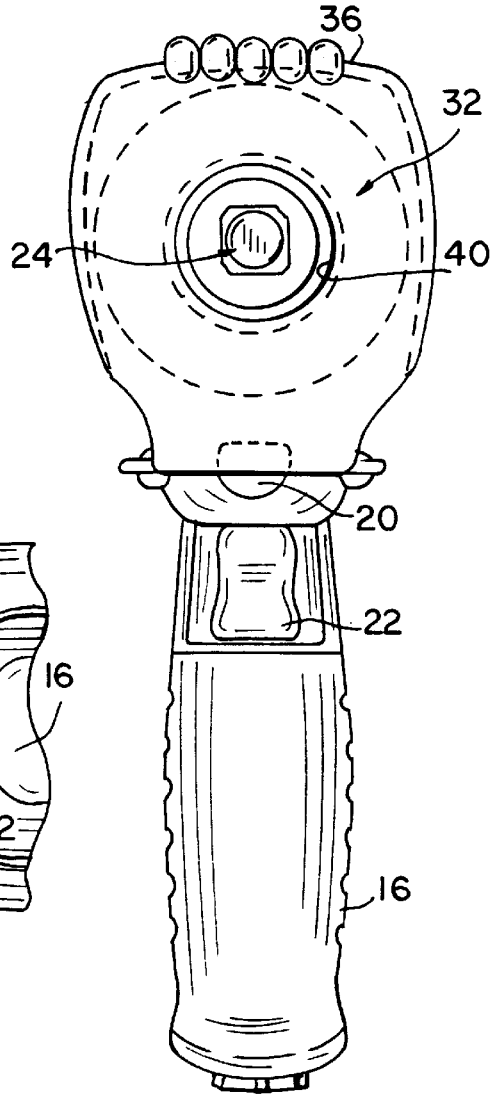
FIG. 3 is a front elevational view of the tool and boot of FIG. 1.

Referring to FIGS. 1–3, a pneumatic tool 10, such as an impact wrench, includes an air inlet 12 and a body 14. The body 14 is of "pistol-grip" configuration and includes a handle 16, a housing 18 for containing a motor (not shown), and an exhaust port 20 for transmitting exhaust air from the tool 10. The housing 18 has an exterior surface 19. The tool 10 also includes a trigger 22 for controlling the amount of air to the motor. The tool 10 also has output structure 24 coupled to and rotated by the motor. The output structure 24 lies along an axis A (FIG. 1). In the present case, the output structure 24 includes a square 26 for coupling to a socket designed to apply torque to a fastener, such as a lug nut for a vehicle wheel. The square 26 has a free end which defines the terminal front end 28 of the tool 10. The pneumatic impact wrench 10 is discussed in much greater detail in commonly assigned and copending application Ser. No. 09/119,683, entitled "Pneumatic Tool With Increased Power Capability", the specification of which is incorporated herein by reference.

The present invention also includes a protective boot 30. The boot 30 is preferably of one-piece construction and formed of a flexible and resilient material, such as a vinyl, or the like. The boot 30 is preferably formed by dip molding, or the like. The boot 30 has a body 31 having front and rear ends 32, 34, and top and bottom sides 36, 38. The boot 30 includes interior and exterior surfaces 39*a* and 39*b*. The body 31 defines a circular first opening 40 at the front end 32 and a second opening 42 at the bottom side 38.

The bottom side 38 of the boot 30 also includes a generally U-shaped deflector 44 extending down from the exterior surface 39*b* along a forward portion of the second opening 42. The deflector 44 has a central forward bight 46 and two rearwardly projecting legs 48, 50.

The boot 30 is disposed about the outside of the housing 18 so that at least a portion of the output structure 24 is disposed through the first opening 40 and the handle 16 is disposed through the second opening 42, and so that the deflector 44 is disposed in front of the exhaust port 20.

When the tool 10 is operated, and the boot 30 is disposed about the housing 18, exhaust air is transmitted out of the exhaust port 20 along a path toward the front end 28 of the tool 10. The deflector 44 has a predetermined shape and projects a predetermined distance down from the exterior surface 19, and the bight 46 is spaced a predetermined distance from the exhaust port 20. In a preferred embodiment, the spacing between the bight 46 and the exhaust port 20 is 0.68 inch and the deflector 44 projects 0.44 inch from the exterior surface 19 of the housing 18. This positioning and shaping causes the exhaust air transmitted through the exhaust port 20 to contact the deflector 44, which then directs it along a path downward or laterally away from the terminal end 28 of the tool 10 (and the workpiece the tool 10 is engaging). The deflector 44 advantageously directs the exhaust air, without creating back pressure in the tool 10, completely away from a circle having a radius R of at least about six inches, wherein the circle is coplanar with the terminal end 28 and coaxial with the housing 18. It should be appreciated that the deflector 44 need not project down to the height of the bottom of the exhaust port 20 because the exhaust air hitting and being deflected down by the deflector 44 forms a wall of air which deflects the remainder of the air exiting the exhaust port 20 below the level of the deflector 44.

The U-shape provides the deflector 44 with structural strength to prevent it from being deformed or displaced by the exhaust air. If the deflector 44 is formed of a strong enough material to resist deformation, it can have other shapes, such as a simple plane disposed generally perpendicular to the axis A. Additionally, the deflector, if properly spaced and shaped, can be separate from the boot 30 and simply attached by conventional means to the housing 18.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A pneumatic tool comprising:

a body having an output end lying along a central longitudinal axis and an exhaust port for exhausting air from the body toward the output end; and an air deflector coupled to the body to redirect exhaust air outside a circle of a predetermined radius at the output end, the circle having the axis at its center and lying in a plane substantially perpendicular to the axis.

2. The tool of claim 1, wherein the radius is at least six inches.

3. The tool of claim 1, wherein the air deflector does not create any back pressure in the tool.

4. The tool of claim 1, wherein the deflector is integral with a protective boot disposed about the outside of the body.

5. A combination comprising:

a pneumatic tool having a motor-containing housing having an exterior surface and an exhaust port for transmitting exhaust air from the tool along a path; and a protective boot disposed about the majority of the exterior surface of the housing and having a deflector disposed in the path of the exhaust air for redirecting the exhaust air.

6. The combination of claim 5, wherein the boot is one-piece.

7. The combination of claim 6, wherein the boot is formed of a flexible resilient material.

8. The combination of claim 6, wherein the boot has first and second apertures and the tool includes a handle disposed through the first aperture and output structure disposed through the second aperture.

9. The combination of claim 8, wherein the exhaust port transmits exhaust air toward the output structure and the deflector directs the exhaust air away from the output structure.

10. The combination of claim 9, wherein the output structure lies along an axis and has a terminal end and the exhaust port is axially spaced from the output structure, wherein the deflector directs exhaust air away from a circular area located at the same axial position as the terminal end, the circular area having the axis at its center and a radius perpendicular to the axis and of a predetermined length.

11. The combination of claim 10, wherein the radius is at least about six inches.

12. The combination of claim 8, wherein the deflector is shaped and spaced from the exhaust port to prevent the creation of back pressure in the tool.

13. The combination of claim 5, wherein the deflector is disposed outside the body.

14. The combination of claim 5, wherein the deflector is U-shaped.

15. A protective boot for a pneumatic tool having a motor-containing housing having an exterior surface and an exhaust port for transmitting exhaust air therethrough, the boot comprising:

a body shaped and dimensioned to be disposed about the majority of the exterior surface of the motor-containing housing in a use condition; and a deflector integral with the body and effective in the use condition to deflect the exhaust air transmitted through the exhaust port.

16. The boot of claim 15, wherein the boot is of one-piece construction.

17. The boot of claim 16, wherein the boot is formed of a flexible resilient material.

18. The boot of claim 17, wherein the boot has interior and exterior surfaces and the deflector projects from the exterior surface.

19. The boot of claim 18, wherein the deflector is U-shaped.

* * * * *

UNITED STATES PATENT AND TRADEMARK OFFICE

CERTIFICATE OF CORRECTION

PATENT NO. : 6,199,383 B1
DATED : March 13, 2001
INVENTOR(S) : Daniel S. Pusateri It is certified that error appears in the above-identified patent and that said Letters Patent is hereby corrected as shown below:

Title page, item (56) Reference Cited, U.S. Patent Documents,
1,712, 437 inventor "imerson" should be -- Jimerson --; and
add reference -- 5,911, 281 6/1999 Treskog et al. --.

Signed and Sealed this

Fourth Day of September, 2001

*Attest:*

Nicholas P. Godici

NICHOLAS P. GODICI
*Acting Director of the United States Patent and Trademark Office*

*Attesting Officer*